US005669080A

United States Patent [19]

Culton

[11] Patent Number: 5,669,080

[45] Date of Patent: Sep. 23, 1997

[54] PROTECTIVE APPARATUS AGAINST BASEBALL PITCHING INJURY

[76] Inventor: Dale M. Culton, 341 Barrett Rd., Emmaus, Pa. 18049

[21] Appl. No.: 700,128

[22] Filed: Aug. 20, 1996

Related U.S. Application Data

[63] Continuation of Ser. No. 309,052, Sep. 20, 1994, abandoned.

[51] Int. Cl.[6] ..... A41D 13/00

[52] U.S. Cl. ..... 2/455; 2/462; 2/463

[58] Field of Search ..... 2/2, 267, 44, 45, 2/268, 908, 455, 459, 461, 462, 463, 467

[56] References Cited

U.S. PATENT DOCUMENTS

| | | | |
|---|---|---|---|
| 925,851 | 6/1909 | Sullivan | 2/2 |
| 932,352 | 8/1909 | Sullivan | 2/2 |
| 1,970,130 | 8/1934 | Dickenson | 2/2 |
| 2,756,429 | 7/1956 | Malachowski | 2/2 |
| 4,272,847 | 6/1981 | Buhler | 2/2 |
| 4,525,875 | 7/1985 | Tomczak | 2/2 |
| 4,993,076 | 2/1991 | Dierickx | 2/2 |

FOREIGN PATENT DOCUMENTS

| | | | |
|---|---|---|---|
| 213443 | 2/1957 | Australia | 2/2 |
| 8803765 | 6/1988 | WIPO | 2/267 |

*Primary Examiner*—Paul C. Lewis
*Attorney, Agent, or Firm*—Sanford J. Piltch

[57] ABSTRACT

The invention is a one-piece, fully adjustable, shock absorbing protective vest. The protective vest is contoured to fully protect the chest, shoulder and upper arm areas of the wearer. The protective vest allows free movement of both arms without pulling out of position or compromising the area of protective coverage. Further, enhancing the flexibility of the protective vest are slits positioned to help the protective vest move with the wearer without pulling the protective vest out of position. The protective vest is attached to the wearer through an adjustable combination of flexible and non-flexible straps which are further adjustable by the use of a dual adjustable piece allowing a full range of adjustment for different body types without compromising protection to the wearer. The protective vest is made from a rubber-like pad that absorbs shock and resists moisture, and is covered on the front with a breathable fabric and on the back facing the wearer with a moisture-wicking fabric that takes moisture from the body, but does not transmit the moisture to the inner pad.

20 Claims, 3 Drawing Sheets

PROTECTIVE APPARATUS AGAINST BASEBALL PITCHING INJURY

CROSS REFERENCE TO RELATED APPLICATIONS

This application is a continuation of U.S. patent application Ser. No. 08/309,052, filed Sep. 20, 1994 now abandoned.

FIELD OF THE INVENTION

The Invention relates generally to protective athletic gear and more particularly to protective athletic gear for the front, upper body and arm areas.

BACKGROUND OF THE INVENTION

Baseball and softball umpires are vulnerable to injury from impact of stray balls and, therefore, wear protective gear over the upper body. In the past there have been various forms of upper body protection available. Most umpires wear modified catcher's gear, that being the best available protection. However, umpires do not assume the same position behind the plate as do catchers. The present invention solves the problems existing in currently available protective gear for umpires, making their jobs easier and safer.

Early protective gear was primarily made of rigid, inflexible material that could not flex or bend with the wearer. This early gear was also uncomfortable because it contained no means for air to circulate to the wearer, and was attached to the wearer by a complex, minimally adjustable harness.

Additionally, the early gear was basically made for catchers, with the possible adaptability for use by umpires. The areas of the body which need protection on an umpire, such as the upper chest, the collarbone and front shoulder areas, the top of the shoulder and the upper arms were not adequately protected by earlier gear.

There was, however, one early protective device for umpires which is described in U.S. Pat. No. 2,001,508 (Tobin). The Tobin apparatus is made of a rigid, inflexible material that can not bend or conform to the wearer's body. More recent protective gear, such as that described in U S. Pat. No. 4,993,076 (Dierickx), have the improved characteristic of being made of a flexible material.

Both Tobin and Dierickx have disadvantages such that neither fully protects the entire shoulder girdle where the two scapulae and collarbones attach to the bones of the arms. Tobin and Dierickx merely cover the front of the collarbone and shoulder but no more. Umpires often receive impacts from stray pitched or hit balls to the top of the shoulder area and towards the side of the neck and need more protection in those areas than current devices can provide.

Another disadvantage of both Tobin and Dierickx is that in order to provide more shoulder protection while still maintaining arm freedom of movement, each has a hinged region where a separate shoulder protecting portion is attached. Having multiple parts complicates use with time being needed to attach or remove the extra piece, introduces points of weakness, compromises protection at the joint areas, and leads to faster failure of the device if the joints fail or the extra parts are lost.

Also disadvantageous in most early protective devices was the harness by which they were attached to the wearer. Prior harnesses were minimally adjustable, being made of straps of either all elastic or all inflexible material attached to the apparatus and the wearer by clips and rings as in Dierickx or by buckles as in Tobin. Both Tobin and Dierickx also have a means for connecting the shoulder portion of the harness to the back portion, but the connecting piece does not add any adjustability and has the effect of causing one part to move if the other is moved, thus causing the straps (if not the whole device) to move out of position requiring repositioning after a hand motion by the umpire.

The prior protective gear was designed to be long enough to cover the lower abdominal, as well as the chest, area of the body. The lower abdominal protection is made unnecessary by an umpire's stance, and can actually encumber an umpire and prohibit the umpire from taking a comfortable stance.

In addition, earlier protective gear that did not allow air to circulate to the wearer have been improved upon by the addition of holes which not only allow air to circulate to the wearer, but also add flexibility. However, though apertures added to enhance flexibility have been used as in Dierickx, they still allow the device to pull and come out of position with movement by the wearer.

Finally, most prior protective gear was not easily worn, if worn at all, under a normal shirt. The gear was either not intended to be worn under a shirt or needed modification such as in Dierickx, where it is recommended that if worn under a shirt, the wearer not use the harness. Removing the harness would then lead to movement of the protective gear under the shirt and a compromise in protection to the wearer.

The present invention solves the problems of these prior devices resulting in more optimal protection for umpires.

One object of the present invention is to improve protection of the upper body, shoulder and upper arm areas of the body by covering these areas of the body with a one-piece protective apparatus.

Another object of the present invention is to make a protective device that is easily, comfortably and unobtrusively worn under a normal shirt.

A further object of the present invention is to provide a one-piece, easily donned protective device, which will encourage use of the device, thereby increasing the overall safety of users.

A still further object of the present invention is to provide a light-weight, one-piece protective apparatus designed specifically with umpires in mind, that is easily deployable, conforms to the wearer's body and movements, is moisture-resistant so as not to become overly soiled, and protects the uniquely vulnerable body areas of an umpire.

SUMMARY OF THE INVENTION

According to the present invention, the foregoing and other objects and advantages are attained by a one-piece apparatus, a protective vest, for protection of an athlete. The apparatus cushions and absorbs the shock of impact to the body from a projectile such as a ball. The protective pad covers the upper and lower chest, to just below the diaphragm, shoulders and upper arm areas of the body. The pad is attached to and positioned on the wearer by a first and second set of fastening means. The apparatus is also shaped to allow easy, free and full arm and shoulder movements without compromising protection.

Another aspect of the present invention is that the fastening means are adjustable for both height and width differences by unique buckling. The first fastening means extends from the shoulders, and down the back to an adjusting buckle attached to a portion of said fastening means which encircles the torso. The second fastening means extends around each of the arm portions of the protective apparatus.

A further aspect of the protective pad is that it is made from a flexible, pliable, resilient material that is also resistant to moisture. The protective pad material is also shock absorbing and vibration dampening such that the shock of impact is not transmitted beyond the pad to the wearer. The protective pad is covered with a breathable fabric on the front with the surface next to the body covered by a material that is absorbant but holds moisture such that the moisture is wicked away from the body but is not transmitted to the material of the protective pad.

The protective vest can be made even more flexible by the addition of an array of elongated apertures aligned and spaced so that the protective pad allows both upward and outward motion while remaining in position for continual protection of the body. The apertures also make the protective pad more light-weight and allow for the protective gear to breathe while passing air to the body.

The present invention enhances the protection of the upper body, shoulders and upper arms while being light-weight, flexible and of one-piece construction. These advantages encourage use of the protective vest and result in greater safety with fewer injuries.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
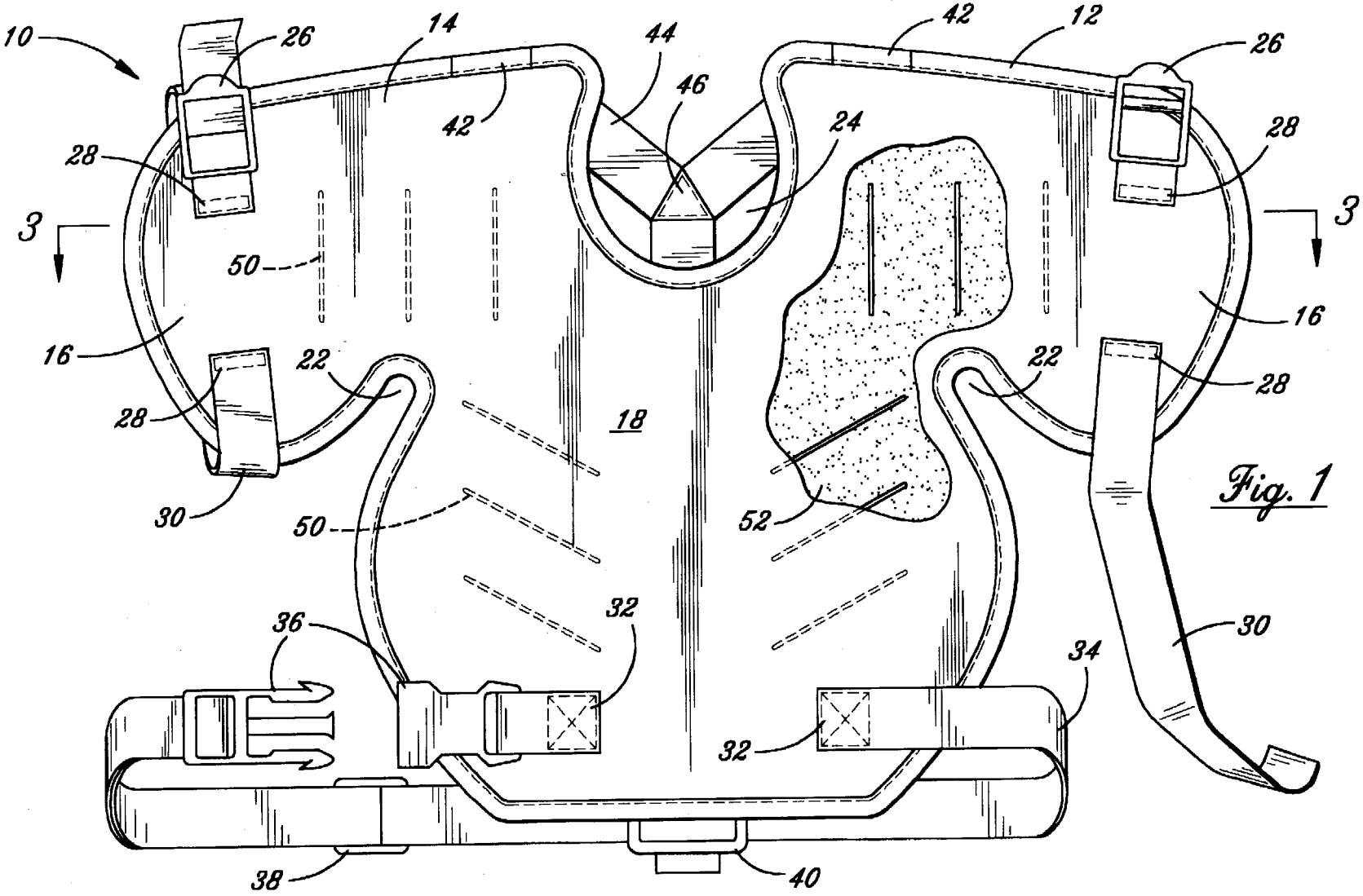
FIG. 1 is a front plan view of the protective apparatus of the present invention.

Referring now to the drawings in detail, where like numerals refer to like parts or elements, there is shown in FIG. 1 an overall plan view of the front of the protective vest 10 used when participating in baseball, softball or other sports. The protective vest 10 is, in general, formed from a flat, flexible, resilient, shock-absorbing material of appropriate size and contour to cover the thorax from the base of the neck to just below the diaphragm, shoulder girdle and upper arm areas of the human body protecting the entire thoracic region. The protective vest 10 is provided with bilateral shoulder and upper arm portions 16, extending from the neck cut out 24 to the arm scye cut outs 22, which cover the entire shoulder girdle protecting the humeral head, upper humerus and structures associated with the articulation of the humeral head to both bony and soft tissue structures. The protective vest 10, with the unique shoulder and upper arm portions 16 and the neck cut out area 24, provides protection to the clavicle from the sternoclavicular joint to its articulation with the scapula and its association with the humeral head, also providing protection to the trapezius muscle as it continues over the shoulder (at the top of the shoulder blades), around and behind the neck. The trapezius muscle and its associated bony structures are the recipients of many impacts from stray balls. The shoulder and upper arm portions 16 of the protective vest 10 also protect the deltoid muscle that forms the lateral aspect of the shoulder.

In order to permit maximum freedom of motion of the arms, the protective vest 10 has bilateral arm scye cutouts 22 enabling left or right handed players or umpires to use the protective vest and have equal, full protection. The arm scye cut outs 22 separate the shoulder and upper arm portions 16 of the vest from the chest portion 18 allowing both shoulders and both arms a full range of motion while still being fully protected by the shoulder and upper arm portions 16 of the vest 10.

The protective vest 10 also has a chest portion, 18, which covers the entire thoracic region of the wearer's body. The entire thoracic region includes protection of the sternum, rib cage, diaphragm and upper abdominal areas of the body. The chest portion 18 is contoured to conform to the shape of the wearer's body which, in turn, provides a greater ability for freedom of movement.

The protective vest 10 is covered with a breathable fabric 14 on the front side, used to cover and protect the underlying protective material. The protective vest is covered with a soft, absorbant material 54 on the back side next to the wearer's body to wick away perspiration from the user and minimize transfer of the moisture to the protective material. This construction yields greater comfort to the wearer. The front and back coverings 14, 54 are attached to each other, and to the protective material 52, by an edging 12 which is stitched down or otherwise secured to hold the front and back coverings 14, 54 and the protective material 52 together.

The protective material 52 is made of closed cell rubber and plastic sheet material having a wide range of properties and made from various polymeric compounds such as Neoprene, Ethylene Propylene Terpolymer, [EPT], Nitrile, [NBR], Styrene-Butadiene, [SBR], Epichlorohydrin, [ECH], Ethylene Vinyl Acetate, [EVA], Chlorinated Polyethylene, [CPE] and Polyvinyl Chloride, [PVC], or composites thereof. These materials are compounded and expanded into a variety of compression deflections (hardnesses) and densities, and possess the same characteristic of tiny individually sealed cells containing inert nitrogen gas to resist moisture, dirt and air even at cut edges. This unique structure makes the closed cell sheet materials a good vibration dampener and shock absorber.

The preferred embodiment of the present invention is for the protective pad 52 to have the following physical characteristics.

TABLE 1

| | |
|---|---|
| Bashore Resilience (% Rebound Averages) @ ½" at 72° Fahrenheit | 9–15% |
| Compression Deflection | |
| (p.s.i.) | 3.5–7 |
| ($kg/cm^2$) | 0.25–0.5 |
| Density | |
| (p.c.f.) | 6–8.5 |
| ($kg/m^3$) | 96–136 |

TABLE 1-continued

| | |
|---|---|
| Elongation (% Min.) | 200 |
| Shore Durometer (Approx. Average) | 40–50 |
| Temperature Range | |
| Low (Flex w/o cracking) | +20° F/−70° C. |
| High Continuous | +130° F/+53° C. |
| High Intermittent | +200° F/+93° C. |
| Tensile Strength (p.s.i. min.) | 80 |
| Thickness (Inches) | 1/16–1 |
| Water Absorption (lbs/sq. ft. of cut surface) | 0.1 |

Two such polymeric compounds which meet the required physical characteristics are Vinyl Nitrile [VN] and Styrene-Butadiene Vinyl [SBR], although other polymeric compounds may be used.

Figure 2:
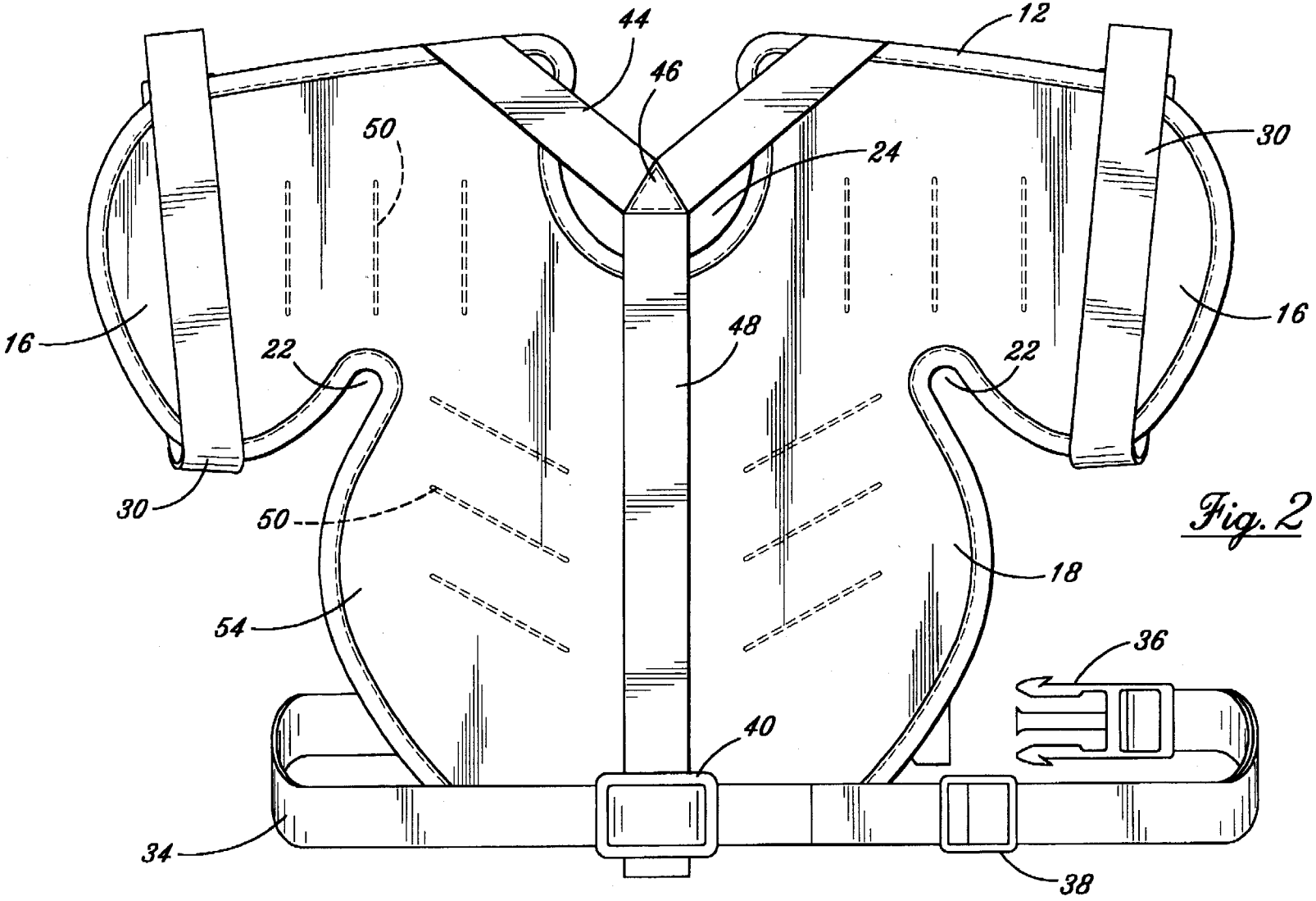
FIG. 2 is a rear plan view of the protective apparatus of the present invention.
Figure 3:
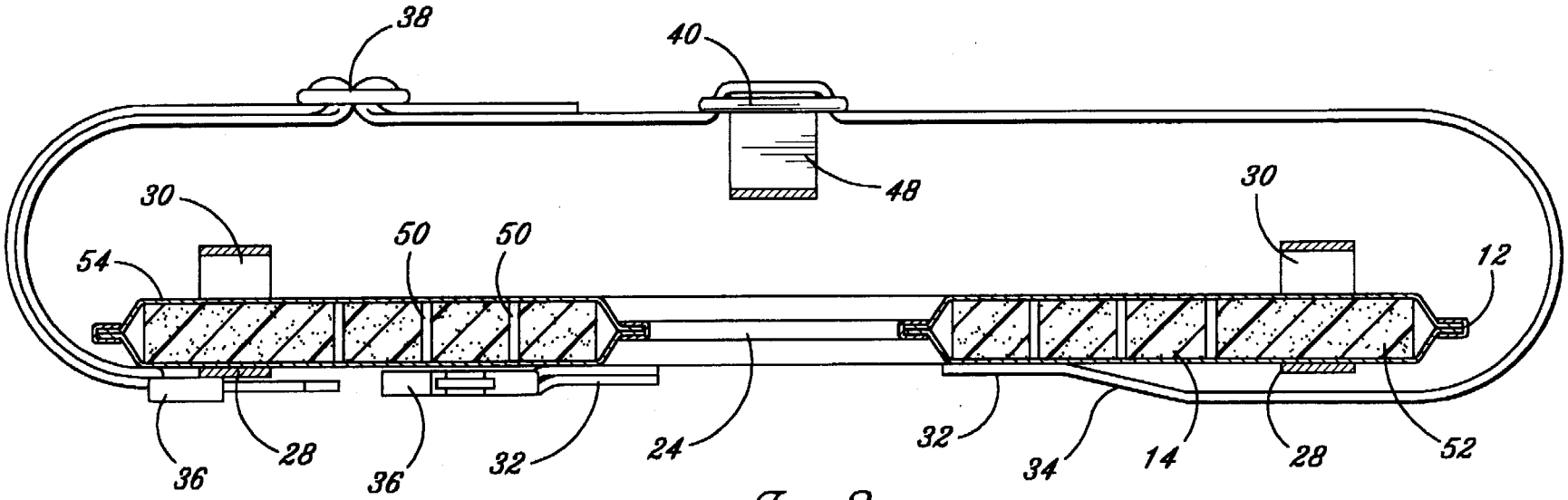
FIG. 3 is a sectional view of the protective apparatus of the present invention taken along Line 3—3 of FIG. 1.

Referring now to FIGS. 2 and 3, the protective vest 10 is attached to the wearer by primary and secondary fastening means including a shoulder Y strap angled portion 44, a shoulder Y strap joint 46, a shoulder Y strap stem 48, a back strap 34 and bilateral arm straps 30. The back strap 34 holds the lower part of the chest portion 18 of the invention in position over the diaphragm and upper abdominal area of the body. The shoulder Y strap 44, 46 and 48 pulls the upper part of the chest portion 18 and the shoulder and upper arm portions 16 of the vest 10 into position by being arranged and attached such that when the vest is deployed the elastic shoulder Y strap 44, 46 creates an elastic flexion to pull the upper chest portion 18 and the shoulder and upper arm portions 16 of the vest 10 against the neck of the wearer and back and over the top of the shoulder and upper arms of the wearer. The bilateral arm straps 30 hold distal parts of the shoulder and upper arm portions 16 of the protective vest 10 in position over the upper arm areas of the body by snugly encircling the arm. The Y strap 44, 46 and 48 is sewn or otherwise attached at bilateral locations 42 to the edging 12 at the top, proximal portions of the shoulder and upper arm portions 16 of the protective vest 10. The bilateral arm straps 30 are sewn to the vest 10 at locations 28 on the distal parts of the shoulder and upper arm portions 16 of the protective vest 10. The back strap 34 is sewn to the vest 10 at locations 32 at each side of the lower part of the chest portion 18 of the protective vest 10.

The arm straps 30 are adjustable in length for size differences by means of an adjusting buckle means 26 on each. Excess arm strap length can be fed through the adjusting buckle means 26 to lengthen or shorten the arm straps 30.

The back strap 34 is adjustable by an adjusting buckle means 38 in the same manner as the arm straps 30. The back strap 34 is releasable, to allow easy employment by the wearer, by means of a side squeeze fastener 36 (having male and female components) which releases so that the vest can be put over the head of the wearer with the back strap fastener 36 open, then adjusted and secured comfortably around the back at the waist by reattaching the side squeeze fastener 36.

The final and most important means for adjustment of the protective vest 10 is the back interconnecting and interlocking means 40 for adjusting the length or height of the Y strap 44, 46, 48 and the length of the back strap 34. In adjusting the protective vest 10, the inflexible stem of the Y strap 48 passes vertically through the interconnecting means 40 to allow vertical adjustment of the protective vest 10 without changing the positioning of the protective vest 10 over the wearer's shoulders and upper arms, and the back strap 34 passes horizontally to allow the back strap to be adjusted for width differences of wearers. The interconnecting means 40 allows adjustment of either the Y or back strap without effect on the strap that is not being adjusted, thus always maintaining the protective vest in optimal position on the user.

Another embodiment of the present invention has an array of groups of elongated apertures 50 located on each side of the chest portion of the protective vest 10 and along both shoulder and upper arm portions 16 of the protective vest 10. The array of elongated apertures 50 most importantly allows the protective vest 10 to flex with the wearer's motion making it easier for the wearer to move while not pulling the protective vest 10 out of its desired position on the wearer's body. The groups of elongated apertures 50 on the chest portion 18 are aligned in parallel placement one to the other and angled upwardly at an angle in the range of 30°–45° from the horizontal, with the vertex of the angle being located adjacent the center line of the vest 10. The groups of elongated apertures 50 on the shoulder and upper arm portions 16 are positioned transverse to the arm of the wearer and substantially parallel to the arm straps 30. The angling and positioning of the groups of arrays is such that when the arms of the wearer are moved upwards, the array allows the vest to flex with the body's motion and not be pulled out of its protective position over the covered areas of the body. The groups of arrays of elongated apertures 50 also give the protective vest 10 breathability in letting air pass through the apertures and provide ventilation to the wearer's body. In addition, the unique contouring and conforming characteristics of the protective vest 10 allow the vest to remain in position over the wearer's body during motion by the wearer.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. An apparatus for protection of an athlete by cushioning and absorbing the shock of impact to the body from a projectile comprising:

a one-piece, continuous protective vest formed from a single piece of a protective material for protecting the torso, shoulder, upper arm areas of a human body extending from the diaphragm, continuing over the shoulder, and stopping at the top of the shoulder blades;

means for attaching and for positioning said protective vest over the torso, shoulder and upper arm areas of the human body for optimal form, fit and protection, said attaching means comprising a primary fastening means and a secondary fastening means for retaining the protective vest in position covering the torso, shoulder and upper arm areas of the human body and said secondary fastening means comprising a strap and adjustment means;

said protective vest further comprising a chest portion, a shoulder portion and an upper arm portion of said protective vest formed by a pair of arm syce cutouts in the single piece of protection to permit full movement of both arms of the human body while continuing to protect the torso, shoulder and upper arm areas of the human body.

2. The apparatus of claim 1 wherein said primary fastening means comprises a Y-strap, a back strap, and a dual adjusting means;

said Y-strap being flexible and non-elastic with an angular portion, a first stem portion and a second stem portion connected at a common joint, said angular portion attaching at the top of said shoulder and upper arm portion of said protective vest and extending to said joint to connect with the non-elastic stem of said Y-strap;

said back strap being flexible and attaching at a first side of the chest portion of said protective vest and extending substantially horizontally around the back of the human body having a releasable closure means located adjacent and attaching to a second side of the chest portion of the front of said protective vest which is opposite said first side; and said dual adjusting means being positioned approximately at the mid-back of the human body along the back strap and joined with the Y-strap, which allows each of the Y-strap and back strap to be adjusted in conjunction with the dual adjusting means without affecting the adjustment of the other strap to provide optimal positioning of the protective vest.

3. The apparatus of claim 2 wherein said Y-strap and said back strap are adjustable by passing both of said straps through said dual adjusting means, said dual adjusting means comprising a plate with two sets of perpendicular slots spaced adjacent its perimeter such that said stem portion of said Y-strap passes vertically through said adjusting means using one set of slots, and said back strap passes horizontally through said adjusting means using the other set of said slots.

4. The apparatus of claim 2 wherein said closure means provides adjustment to said back strap by passing said back strap through an adjustable buckle means of said closure means by which said back strap can be shortened or lengthened.

5. The apparatus of claim 2 wherein said releasable closing means comprises a side-squeeze fastener.

6. The apparatus of claim 1 wherein said secondary fastening means comprises each of two flexible, elastic arm straps, each being attached to the front and back of each of the upper arm portions of said protecting means through which an athlete's arms are inserted to hold said upper arm portions of said protective vest in position.

7. The apparatus of claim 6 wherein said secondary fastening means is adjustable by passing said arm straps through an adjustable buckle means by which said arm straps of said secondary fastening means can be shortened or lengthened.

8. The apparatus of claim 1 wherein said protective vest being formed from a resilient, pliable material resistant to deterioration through exposure to moisture and having the physical characteristics of vibration dampening and shock absorption such that when struck by a projectile the energy of the projectile is absorbed and distributed throughout said protective vest.

9. The apparatus of claim 1 wherein the outer surface of said protective vest is covered with a breathable fabric, and the surface next to the body being covered by an absorbent fabric which holds any moisture absorbed such that the transfer of moisture from said absorbent fabric to said protective vest is minimized.

10. An apparatus for protection of an athlete by cushioning and absorbing the shock of impact to the body from a projectile comprising:

a one-piece, continuous protective vest formed from a single piece of a protective material for protecting the torso, shoulder, upper arm areas of a human body extending from the diaphragm, continuing over the shoulder, and stopping at the top of the shoulder blades;

means for attaching and for positioning said protective vest over the torso, shoulder and upper arm areas of the human body for optimal form, fit and protection, said attaching means comprising a primary fastening means and a secondary fastening means for retaining the protective vest in position covering the torso, shoulder and upper arm areas of the human body and said secondary fastening means comprising a strap and adjustment means;

an array of slits for circulating air through said protective vest to the torso, shoulder and upper arm areas of the human body;

said protective vest further comprising a chest portion, a shoulder portion and an upper arm portion of said protective vest formed by a pair of arm syce cutouts in the single piece of protective material to permit full movement of both arms of the human body while continuing to protect the torso, shoulder and upper arm areas of the human body.

11. The apparatus of claim 10 wherein said primary fastening means comprises a Y-strap, a back strap, and a dual adjusting means;

said Y-strap being flexible and non-elastic with an angular portion, a first stem portion and a second stem portion connected at a common joint, said angular portion attaching at the top of said shoulder and upper arm portion of said protective vest and extending to said joint to connect with the non-elastic stem of said Y-strap;

said back strap being flexible and attaching at a first side of the chest portion of said protective vest and extending substantially horizontally around the back of the human body having a releasable closure means located adjacent and attaching to a second side of the chest portion of the front of said protective vest which is opposite said first side; and said dual adjusting means being positioned approximately at the mid-back of the human body along the back strap and joined with the Y-strap, which allows each of the Y-strap and back strap to be adjusted in conjunction with the dual adjusting means without affecting the adjustment of the other strap to provide optimal positioning of the protective vest.

12. The apparatus of claim 11 wherein said Y-strap and said back strap are adjustable by passing both of said straps through said dual adjusting means, said dual adjusting means comprising a plate with two sets of perpendicular slots spaced adjacent its perimeter such that said stem portion of said Y-strap passes vertically through said adjusting means using one set of slots, and said back strap passes horizontally through said adjusting means using the other set of said slots.

13. The apparatus of claim 11 wherein said closure means provides adjustment to said back strap by passing said back strap through an adjustable buckle means of said closure means by which said back strap can be shortened or lengthened.

14. The apparatus of claim 11 wherein said releasable closing means comprises a side-squeeze fastener.

15. The apparatus of claim 10 wherein said secondary fastening means comprises each of two flexible, elastic arm straps, each being attached to the front and back of each of the upper arm portions of said protective vest through which an athlete's arms are inserted to hold said upper arm portions of said protective vest in position.

16. The apparatus of claim 15 wherein said secondary fastening means is adjustable by passing said arm straps through an adjustable buckle means by which said arm straps of said secondary fastening means can be shortened or lengthened.

17. The apparatus of claim 10 wherein said protective vest being formed from a resilient, pliable material resistant to deterioration through exposure to moisture and having the physical characteristics of vibration dampening and shock absorption such that when struck by a projectile the energy of the projectile is absorbed and distributed throughout said protective vest.

18. The apparatus of claim 10 wherein the outer surface of said protective vest being covered with a breathable fabric, and the surface next to the body being covered by an absorbent fabric which holds any moisture absorbed such that the transfer of moisture from said absorbent fabric to said protective vest is minimized.

19. The apparatus of claim 10 wherein said array of slits are arranged in patterns on the torso, shoulder and upper arm portions of the protecting means to assist ease of motion of the protective vest so as not to restrain any motion of the arms of the athlete.

20. An apparatus for protection of an athlete by cushioning and absorbing the shock of impact to the body from a projectile comprising:

a protective vest formed from a single piece of a protective material, said protective vest being comprised of a chest portion for protecting the front of the torso from the diaphragm to the shoulders and a shoulder and an upper arm portion for protecting the upper part of the arms and the shoulders which extends over the shoulders stopping at the top of the shoulder blades said portions partially formed by a pair of arm scye cutouts;

means for attaching and for positioning said protective vest over the torso, shoulder and upper arm areas of the human body for optimal form, fit and protection, said attaching means comprising a primary fastening means and a secondary fastening means for retaining the protective vest in position covering the torso, shoulder and upper arm areas of the human body and said secondary fastening means comprising a strap and adjustment means.

* * * * *